US012753542B2

(12) United States Patent
Alves et al.

(10) Patent No.: US 12,753,542 B2
(45) Date of Patent: Oct. 6, 2026

(54) LAUNDRY MACHINE

(71) Applicant: WHIRLPOOL CORPORATION, Benton Harbor, MI (US)

(72) Inventors: Robison Alves, Rio Claro (BR); Samuel Bozzi Baco, Rio Claro (BR); Fernando Gonzalez Nogueira, Saint Joseph, MI (US); Varadharajan J, Pondicherry (IN); Eduardo Lopez, Saint Joseph, MI (US); Anderson L Moreira, São Paulo (BR); Bradley D. Morrow, Stevensville, MI (US); Leonardo Vitaletti, Fabriano (IT); Santosh Winfred, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 359 days.

(21) Appl. No.: 18/487,489

(22) Filed: Oct. 16, 2023

(65) Prior Publication Data

US 2025/0122663 A1 Apr. 17, 2025

(51) Int. Cl.

| | |
|---|---|
| ***D06F 23/04*** | (2006.01) |
| ***D06F 37/12*** | (2006.01) |
| ***D06F 37/36*** | (2006.01) |
| ***D06F 37/40*** | (2006.01) |

(52) U.S. Cl.

CPC ..... *D06F 37/36* (2013.01); *D06F 23/04* (2013.01); *D06F 37/12* (2013.01); *D06F 37/40* (2013.01)

(58) Field of Classification Search

USPC ..... 68/12.24

See application file for complete search history.

(56) References Cited

U.S. PATENT DOCUMENTS

| | | | |
|---|---|---|---|
| 2,442,482 | A | 6/1948 | Bancroft |
| 2,575,691 | A | 11/1951 | Smith |
| 2,993,388 | A | 7/1961 | Briall et al. |
| 4,998,052 | A | 3/1991 | Erdman et al. |
| 5,655,389 | A | 8/1997 | Johnson et al. |
| 8,499,392 | B2 | 8/2013 | Suel, II et al. |
| 9,284,676 | B2 | 3/2016 | Choi et al. |
| 11,268,228 | B2 | 3/2022 | Han et al. |
| 2012/0124755 | A1 | 5/2012 | Watkins et al. |

FOREIGN PATENT DOCUMENTS

| | | | |
|---|---|---|---|
| CN | 108149439 | A | 6/2018 |
| EP | 0957195 | A2 | 11/1999 |
| EP | 3831999 | A1 | 6/2021 |
| KR | 100395255 | B1 | 8/2003 |
| KR | 100778692 | B1 | 11/2007 |

*Primary Examiner* — Levon J Shahinian

(74) *Attorney, Agent, or Firm* — Brooks Kushman P.C.

(57) ABSTRACT

A laundry machine includes an agitator, an electric machine, a first pulley, a second pulley, and a belt. The electric machine is configured to generate power. The first pulley is connected to the electric machine. The second pulley is connected to the agitator. The belt connects the first pulley to the second pulley. The first pulley, the second pulley, and the belt are configured to collectively (i) deliver power from the electric machine to the agitator and (ii) reduce a rotational speed of the agitator relative to a rotational speed of the electric machine.

6 Claims, 5 Drawing Sheets

LAUNDRY MACHINE

TECHNICAL FIELD

The present disclosure relates to washing or laundry machines.

BACKGROUND

Washing machines are configured to clean clothes, garments, or other clothing articles.

SUMMARY

A laundry machine includes a spin tube, an agitator shaft, an electric machine, a first pulley, a second pulley, a belt, and a clutch system. The agitator shaft is disposed within the spin tube. The electric machine is configured to generate power. The first pulley is secured to the electric machine. The second pulley is secured to the agitator shaft. The belt connects the first pulley to the second pulley. The first pulley, the second pulley, and the belt are configured to collectively (i) deliver power from the electric machine to the agitator shaft and (ii) drive a rotational speed of the agitator shaft at a lower speed relative to a rotational speed of the electric machine. The clutch system includes a sleeve, a lever, and an actuator. The sleeve is configured to transition between first and second positions to connect and disconnect the agitator shaft to and from the spin tube, respectively. The lever (i) engages the sleeve and (ii) is configured to pivot between third and fourth positions to transition the sleeve between the first and second positions, respectively. The actuator is configured to transition the lever between the third and fourth positions. The actuator is oriented at an angle such that the actuator extends radially outward and upward relative to a center of the second pulley.

A laundry machine includes an agitator, an electric machine, a first pulley, a second pulley, and a belt. The electric machine is configured to generate power. The first pulley is connected to the electric machine. The second pulley is connected to the agitator. The belt connects the first pulley to the second pulley. The first pulley, the second pulley, and the belt are configured to collectively (i) deliver power from the electric machine to the agitator and (ii) reduce a rotational speed of the agitator relative to a rotational speed of the electric machine. A ratio of the rotational speed of the electric machine relative to the rotational speed of the agitator resulting from the connection between the first pulley and the second pulley via the belt ranges between 3:1 and 13:1.

A laundry machine includes a tube, a drum, a shaft, an agitator, an electric machine, a first pulley, a second pulley, a belt, a clutch, and an actuator. The tube is secured to the drum. The shaft is secured to the agitator. The agitator is disposed within the drum. The electric machine is configured to generate power. The first pulley is secured to the electric machine. The second pulley is secured to the shaft. The belt connects the first pulley to the second pulley. The first pulley, the second pulley, and the belt are configured to collectively (i) deliver power from the electric machine to the shaft and (ii) rotate the shaft at a rotational speed lower than a rotational speed of the electric machine. The clutch is configured to connect and disconnect the shaft to and from the tube. The actuator is configured to operate the clutch to connect and disconnect the shaft to and from the tube. The actuator is oriented at an angle such that the actuator actuates along an axis that extends radially outward and upward relative to a center of the second pulley.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Illustrative washing machines in accordance with the present disclosure include a rotatable clothes mover or agitator and a rotatable basket or drum. Clothes movers generally oscillate, or rotate back and forth, in accordance with a stroke angle, to provide agitation to a laundry load during washing operations. Clothes movers and rotatable baskets generally spin together during spin cycle operations. To enable both of these functionalities, including oscillation by the clothes mover and joint spinning by the clothes mover and basket, a common drive system may be included. Such a drive system can include a drive mechanism or transmission for translating movement from an electric machine or motor into rotational movement of the basket and clothes mover by the use of a drive shaft that is operably coupled to a series of gears or gearing arrangement. Traditional drive mechanisms may include the use of a sun gear, a set of planetary gears, and an external ring gear. The planetary gears are often provided as spur gears. However, the gears may alternatively be helical gears in place of conventional spur gears in the drive mechanism. Traditional drive mechanisms, however, are not limited to planetary gear systems.

Figure 1:
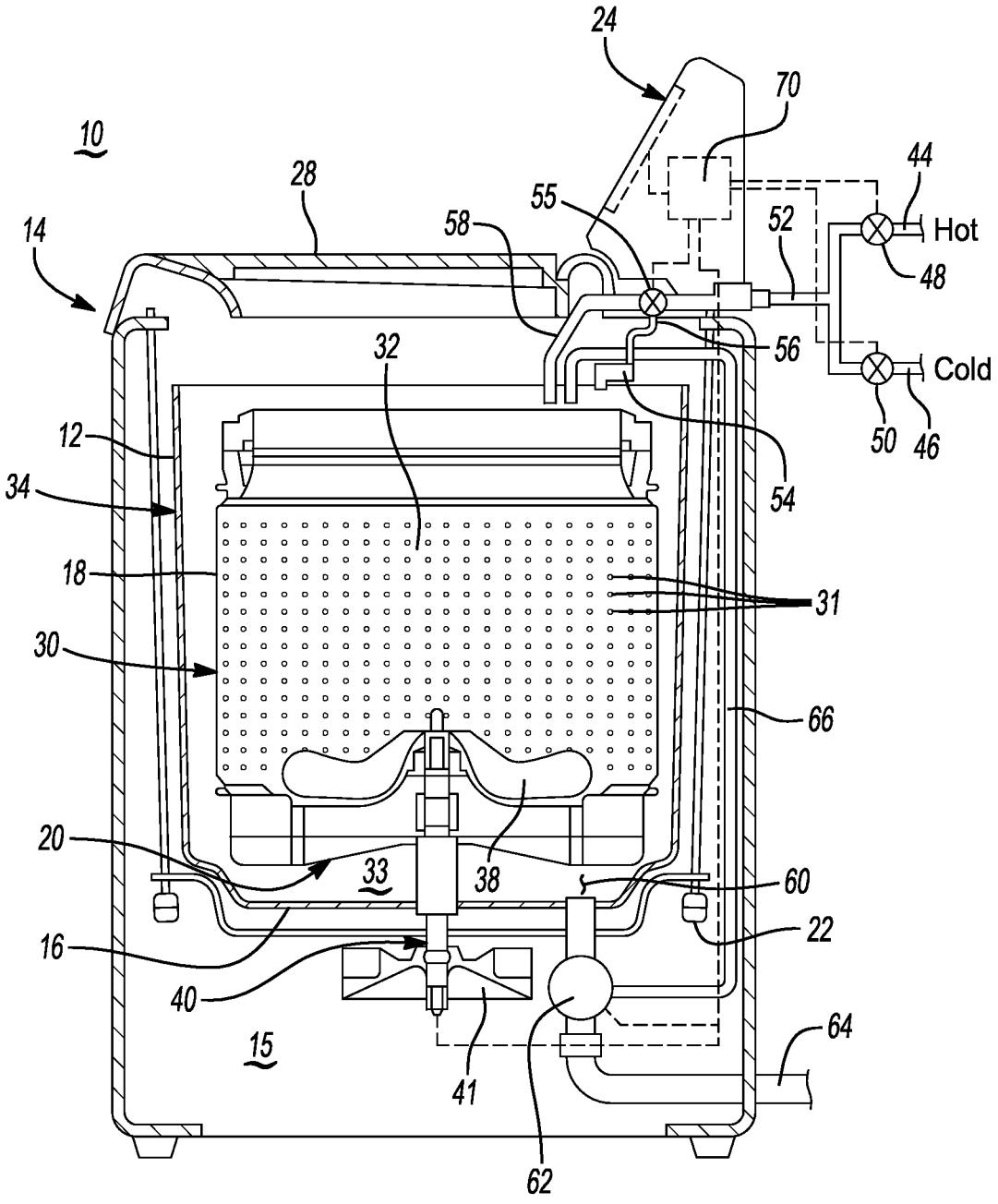
FIG. 1 illustrates a schematic cross-sectional view of a laundry treating appliance in the form of a laundry or washing machine according to the present disclosure.

FIG. 1 illustrates a schematic cross-sectional view of a laundry treating appliance shown in the form of a laundry or washing machine 10 according to one embodiment of the present disclosure. While the laundry treating appliance is illustrated as a vertical axis, top-fill washing machine, the embodiments of the present disclosure can have applicability in other fabric treating appliances, non-limiting examples of which include a combination washing machine and dryer, a refreshing/revitalizing machine, an extractor, or a non-aqueous washing apparatus.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

The washing machine 10 may include a structural support system comprising a cabinet 14 that defines an interior space or internal cavity 15, within which a laundry holding system resides. The cabinet 14 may be a housing having a chassis and/or a frame defining an interior that receives components typically found in a conventional washing machine, such as electric machines (e.g., motors), pumps, fluid lines, controls, sensors, transducers, and the like. Such components will not be described further herein except as necessary for a complete understanding of the present disclosure.

The fabric holding system of the illustrated exemplary washing machine 10 may include a rotatable drum or basket 30 having an open top that can be disposed within the interior of the cabinet 14 (e.g., within internal cavity 15) and may define second internal space, internal cavity, or treating chamber 32 for receiving laundry articles or items for treatment. The top of the cabinet 14 can include a selectively openable lid 28 to provide access into the laundry treating chamber 32 through the open top of the basket 30. A washtub or tub 34 can also be positioned within the internal cavity 15 defined by the cabinet 14 and can define a third interior space or internal cavity 33 within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation relative to the tub 34 and can include a plurality of perforations 31, such that liquid may flow between the tub 34 and the rotatable basket 30 through the perforations 31. While the illustrated washing machine 10 includes both the tub 34 and the basket 30, with the basket 30 defining the treating chamber 32, it is within the scope of the present disclosure for the laundry treating appliance to include only one receptacle, with the receptacle defining the laundry treatment chamber for receiving the load to be treated.

An agitator or clothes mover 38 may be disposed and rotatably mounted within the basket 30 to impart mechanical agitation to a load of laundry placed in the basket 30. The clothes mover 38 can be oscillated or rotated about its axis of rotation during a cycle of operation in order to produce load motion effective to wash the load contained within the treating chamber 32. Types of laundry movers include, but are not limited to, an agitator, a wobble plate, and a hybrid impeller/agitator.

The basket 30 and the clothes mover 38 may be driven by a drive system 40 that includes power sources, such as an electric machine or motor 41, and a transmission operably coupled with the basket 30 and clothes mover 38. The electric machine or motor 41 is configured to generate power to rotate the basket 30 and the clothes mover 38, and to oscillate the clothes mover 38. The transmission is configured to deliver power from a power source (e.g., motor 41) to the basket 30 and/or the clothes mover 38. The transmission may include a gearing arrangement or gear case. The transmission may also include additional components such as input and output shafts. The motor 41 may rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch can be included in the drive system 40 and can selectively operably couple the motor 41 with either the basket 30 and/or the clothes mover 38.

A suspension system 22 can dynamically hold the tub 34 within the cabinet 14. The suspension system 22 can dissipate a determined degree of vibratory energy generated by the rotation of the basket 30 and/or the clothes mover 38 during a treating cycle of operation. Together, the tub 34, the basket 30, and any contents of the basket 30, such as liquid and laundry items, define a suspended mass for the suspension system 22.

A liquid supply system can provide liquid, such as water or a combination of water and one or more wash aids, such as detergent, into the treating chamber 32. The liquid supply system may include a water supply configured to supply hot or cold water. The water supply may include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated as positioned on the exterior of the cabinet 14, it may be understood that these components may be internal to the housing.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system may be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, and recirculation and drain system are shown for exemplary purposes only and are not limited to the systems shown in the drawings and described above. For example, the liquid supply, recirculation, and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 may further include a controller 70 coupled with various working components of the washing machine 10 to control the operation of the working components and to implement one or more treating cycles of operation. The control system can further include a user interface 24 that is operably coupled with the controller 70. The user interface 24 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
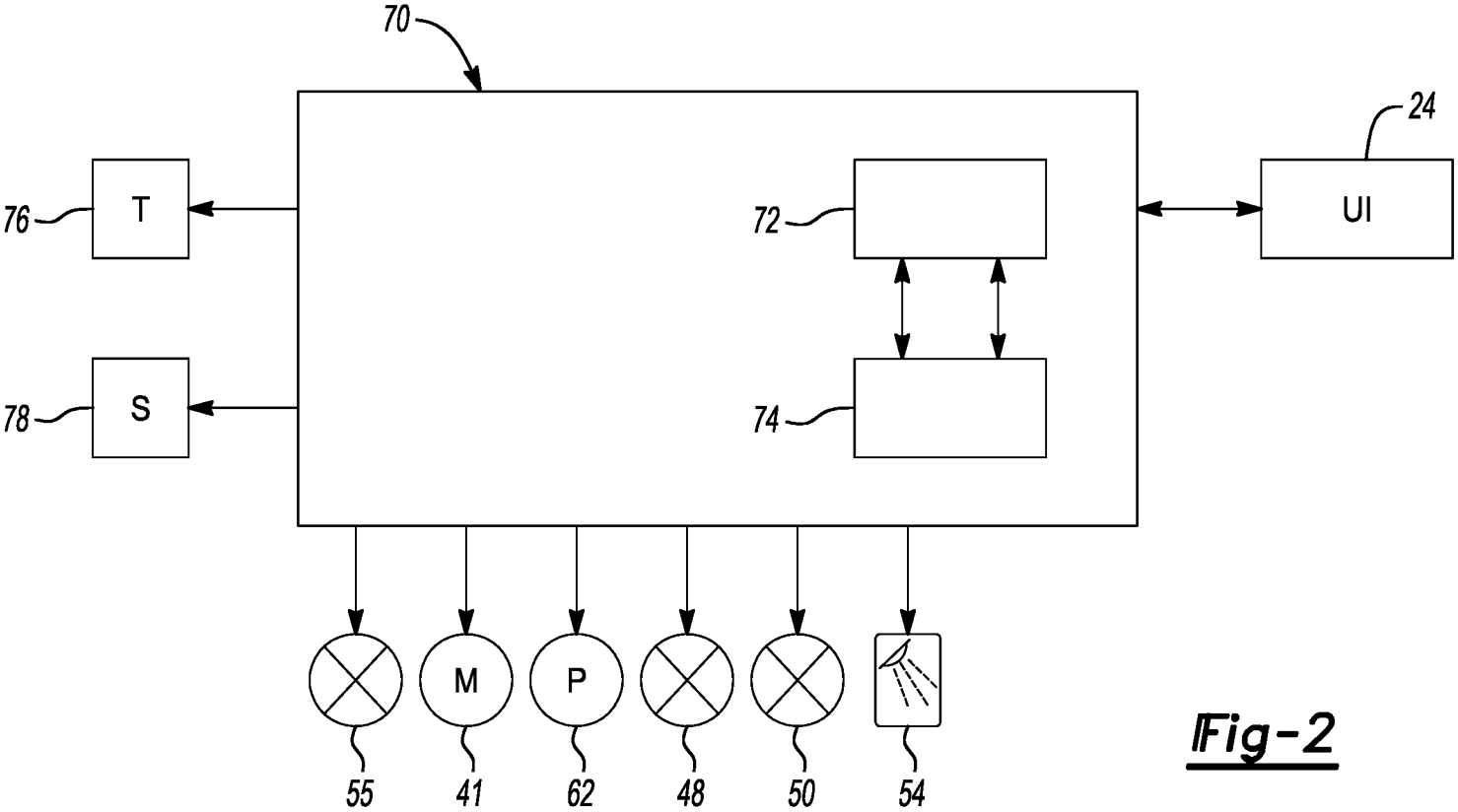
FIG. 2 illustrates a schematic representation of a controller for controlling the operation of one or more components of the laundry treating appliance.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 24. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 may be operably coupled with one or more components of the washing machine 10 for communicating with and/or controlling the operation of the components to complete a cycle of operation. For example, the controller 70 may be coupled with the hot water valve 48, the cold water valve 50, diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

While illustrated as one controller, the controller 70 may be part of a larger control system and may control or be controlled by various other controllers throughout the washing machine 10. It should therefore be understood that the controller 70 and one or more other controllers can collectively be referred to as a "controller" that controls various subcomponents or actuators of the washing machine 10 in response to signals from various subcomponents or sensors of the washing machine 10 to control various functions. The controller 70 may include the microprocessor or central processing unit (CPU) 74, which may be in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 70 in controlling the washing machine 10.

Control logic or functions performed by the controller 70 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based controller, such as controller 70. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the washing machine 10 or its subsystems. The computer-readable storage devices or media may include one or more of a number of known physical devices which utilize electric, magnetic, and/or optical storage to keep executable instructions and associated calibration information, operating variables, and the like.

Figure 3A:
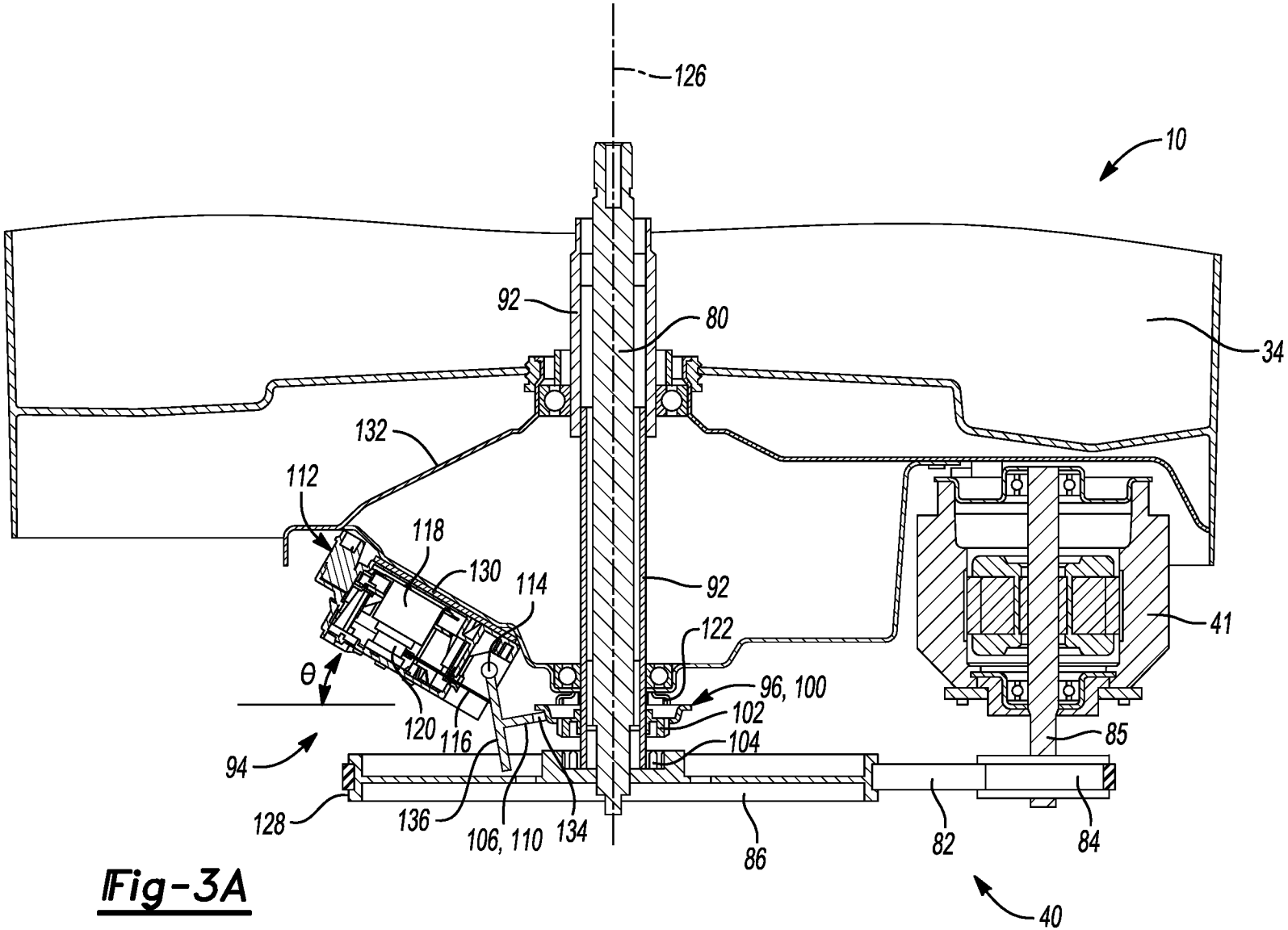
FIGS. 3A and 3B are partial cross-sectional views of the lower end of laundry treating appliance taken along line 3-3 in FIG. 4 illustrating a drive system for the laundry treating appliance and different positions of a clutch system.
Figure 3B:
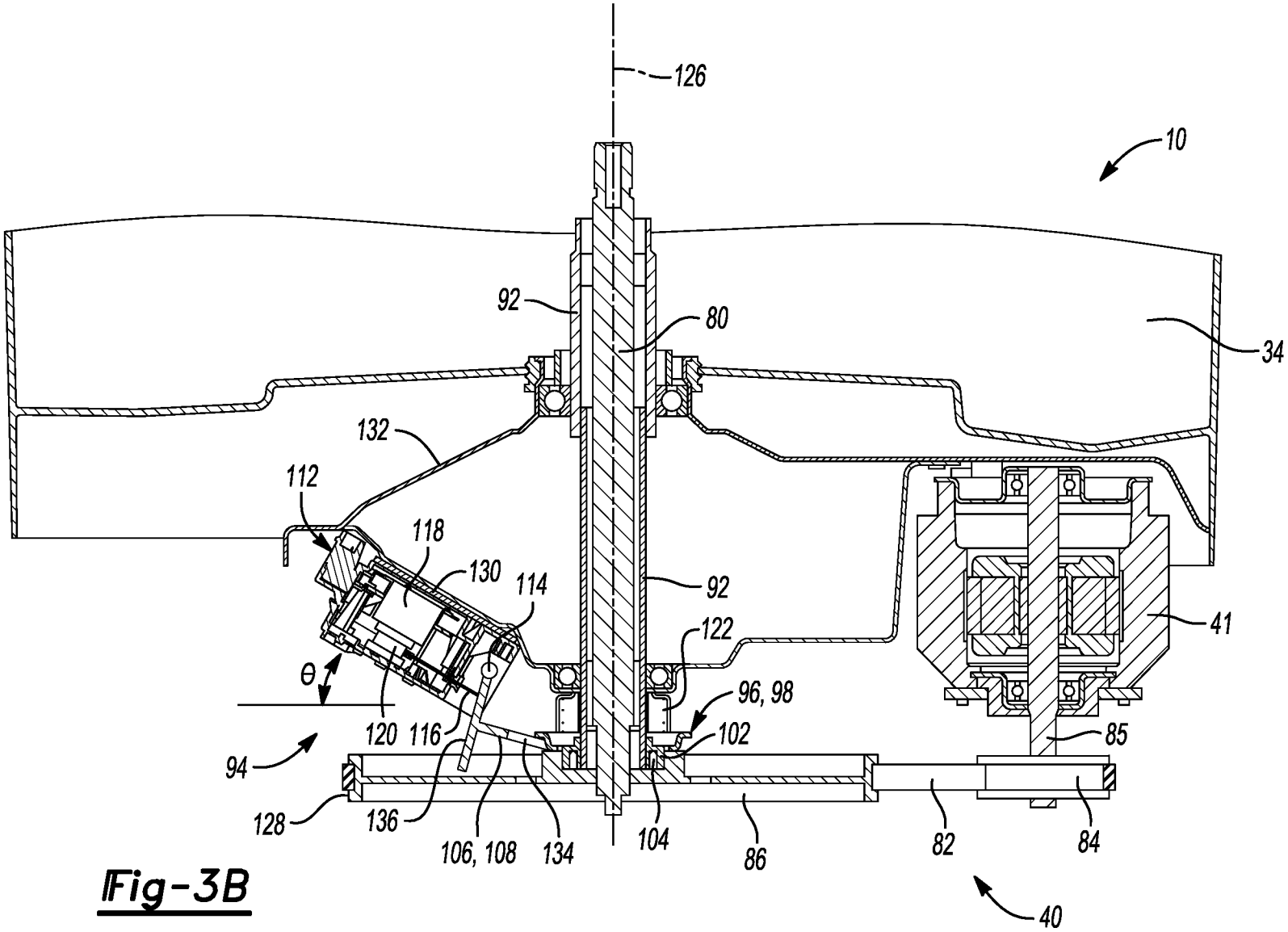
Figure 4:
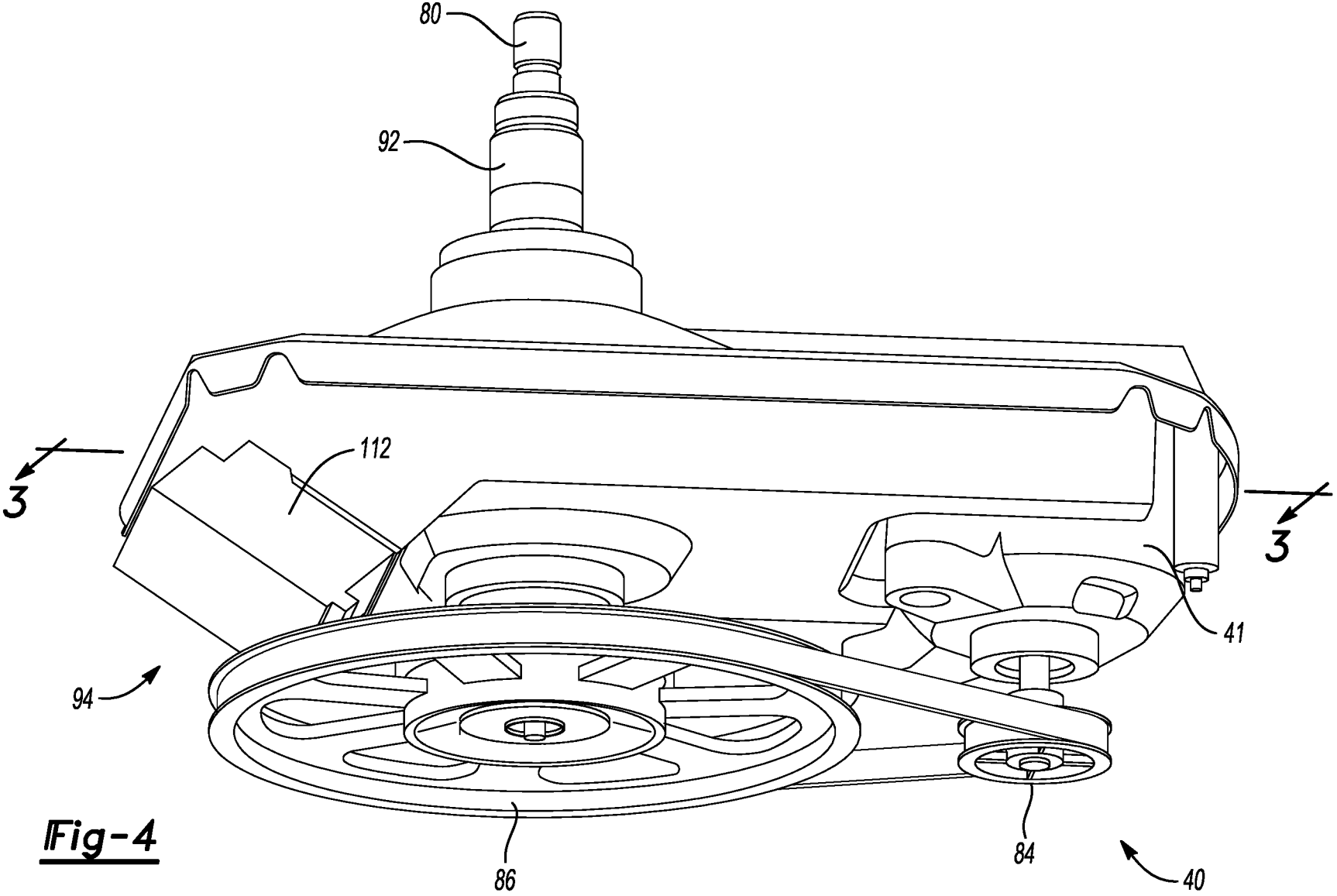
FIG. 4 is a partial isometric bottom view of the lower end of laundry treating appliance illustrating the clutch system.

Referring to FIGS. 3A-4, the drive system 40 and a corresponding clutch system 94 of the washing machine 10 are illustrated in further detail. Please note that the configuration of the drive system 40 may be the same or may vary in FIGS. 3A-4 relative to the configuration of the drive system 40 illustrated in FIG. 1. Also, please note that for illustrative purposes, some of the components in FIGS. 3A and 3B may be shown in a cross-section while other components are not.

The drive system 40 includes the motor 41. The motor 41 generates and delivers power to an agitator shaft 80 via a belt 82. The agitator shaft 80 may be connected or secured to an agitator (e.g., the clothes mover 38). More specifically, the agitator shaft 80 may be connected or secured directly to the agitator (e.g., the clothes mover 38) such that the agitator shaft 80 and agitator are constrained to rotate in unison. The belt 82 engages a drive pulley or a first pulley 84 that is attached or secured to the motor 41. More specifically, the first pulley 84 may be attached or secured to a rotor shaft 85 of the motor 41. The belt 82 also engages a driven or second pulley 86 that is attached or secured to the agitator (e.g., the clothes mover 38), to form a power path from the motor 41 to the agitator. More specifically, the second pulley 86 may be attached or secured to the agitator shaft 80, to form a power path from the motor 41 to the agitator shaft 80 and the agitator (e.g., the clothes mover 38). There may be a direction connection and no gear reduction between second pulley 86 and the corresponding agitator (e.g., the clothes mover 38) such that the second pulley 86, agitator shaft 80, and corresponding agitator are constrained to rotate in unison. The belt 82 connects the first pulley 84 to the second pulley 86. Alternatively, the motor 41 may be connected directly to the agitator shaft 80 as illustrated in FIG. 1. The operation of the motor 41 may be configured to change rotational directions at regular intervals during a washing cycle to oscillate the agitator shaft 80 and the corresponding agitator (e.g., the clothes mover 38).

The first pulley 84, the second pulley 86, and the belt 82 are configured to collectively deliver power from the motor 41 to the agitator shaft 80 and the corresponding agitator (e.g., the clothes mover 38). The first pulley 84, the second pulley 86, and the belt 82 are configured to collectively reduce a rotational speed of the agitator shaft 80 and the corresponding agitator (e.g., the clothes mover 38) relative to a rotational speed of the motor 41 (e.g., the rotational speed of the rotor shaft 85 of the motor 41). Stated in other terms, the first pulley 84, the second pulley 86, and the belt 82 are configured to collectively drive a rotational speed of the agitator shaft 80 and the corresponding agitator (e.g., the clothes mover 38) or rotate the agitator shaft 80 and the corresponding agitator at a lower rotational speed relative to a rotational speed of the motor 41 (e.g., the rotational speed of the rotor shaft 85 of the motor 41). A ratio of the rotational speed of the motor 41 relative to the rotational speed of the agitator shaft 80 and the corresponding agitator (e.g., the clothes mover 38) resulting from the connection between the first pulley 84 and the second pulley 86 via the belt 82 ranges between 3:1 and 13:1. The first pulley 84, the second pulley 86, and the belt 82 configuration operate to both reduce the rotational speed of the agitator shaft 80 and the corresponding agitator (e.g., the clothes mover 38) and increase the torque of the agitator shaft 80 and the corresponding agitator (e.g., the clothes mover 38) relative to the motor 41.

A spin shaft or spin tube 92 is connected or secured to the rotatable drum or basket 30. More specifically, the spin tube 92 may be connected or secured to the rotatable drum or basket 30 such that the spin tube 92 and basket 30 are constrained to rotate in unison. A clutch system 94 is configured to connect and disconnect the spin tube 92 to and from the agitator shaft 80. The agitator shaft 80 may be disposed within the spin tube 92. The agitator shaft 80 may also be concentric with the spin tube 92. When the clutch system 94 is disengaged (e.g., when the spin tube 92 is disconnected from the agitator shaft 80), a power path flows from the motor 41 to the agitator shaft 80 and to the corresponding agitator (e.g., the clothes mover 38). The motor 41 may change rotational directions at regular intervals while the clutch system 94 is disengaged to oscillate the agitator shaft 80 and the corresponding agitator back in forth in opposing rotational directions, while the spin tube 92 and basket 30 remain motionless. The clutch system 94 may be disengaged during a washing or agitation cycle of the washing machine 10. When the clutch system 94 is engaged (e.g., when the spin tube 92 is connected to the agitator shaft 80), the agitator shaft 80 and the spin tube 92 may be constrained to rotate in unison. Also, when the clutch system 94 is engaged, a power path flows from the motor 41, through the spin tube 92, and to the basket 30 to rotate the basket 30. More specifically, the power path may flow from the motor 41 and to the spin tube 92 and basket 30 via the first pulley 84, belt 82, second pulley 86, agitator shaft 80, and clutch system 94 when the clutch system 94 is engaged. The clutch system 94 may be engaged during a spin cycle of the washing machine 10.

The clutch system 94 include a clutch sleeve 96. The clutch sleeve 96 may also be referred to as the clutch or the sleeve. The clutch sleeve 96 is configured to activate and deactivate to connect and disconnect the spin tube 92 (and ultimately the basket 30) to and from the motor 41 and a corresponding power path from the motor 41, respectively. More specifically, the clutch sleeve 96 is configured to transition between an engaged state corresponding to first position 98 of the clutch sleeve 96 (e.g., FIG. 3B) and a disengaged state corresponding to second position 100 of the clutch sleeve 96 (e.g., FIG. 3A) to connect and disconnect the spin tube 92 to and from the agitator shaft 80, respectively. Ultimately, the clutch sleeve 96 is configured to transition between the first position 98 and the second position 100 to connect and disconnect the spin tube 92 to and from the motor 41 and the corresponding a power path from the motor 41, respectively. Alternatively, it may be stated that the clutch sleeve 96 is configured to connect and disconnect agitator shaft 80 to and from the spin tube 92.

The clutch sleeve 96 may include teeth or serrations 102 that engage opposing teeth or serrations 104 on the second pulley 86 when the clutch sleeve 96 is in the first position 98, which corresponds to the engaged state, to connect the spin tube 92 to the agitator shaft 80 via the second pulley 86 such that the spin tube 92 and the agitator shaft 80 are constrained to rotate in unison. The teeth or serrations 102 on the clutch sleeve 96 disengage the opposing teeth or serrations 104 on the second pulley 86 when the clutch sleeve 96 is in the second position 100, which corresponds to the disengaged state, such that the spin tube 92 is disconnected from the agitator shaft 80 and second pulley 86, and such that the spin tube 92 and the agitator shaft 80 are not constrained to rotate in unison. The clutch sleeve 96 may be secured to the spin tube 92 via splines such that clutch sleeve 96 and spin tube 92 are constrained to rotate in unison. The clutch sleeve 96 may be slidable along the splines to transition between the first position 98 and the second position 100. The second pulley 86 may be secured to the agitator shaft 80 via splines such the second pulley 86 and the agitator shaft 80 are constrained to rotate in unison.

The clutch system 94 also includes a fork or lever 106 that engages the clutch sleeve 96. The lever 106 is configured to pivot to activate and deactivate the clutch sleeve 96 to connect and disconnect the spin tube 92 (and ultimately the basket 30) to and from the agitator shaft 80 and a corresponding a power path from the motor 41, respectively. More specifically, the lever 106 is configured to (i) transition (e.g., pivot) to a third position 108 to lower and transition the clutch sleeve 96 to the engaged state corresponding to first position 98 and (ii) transition (e.g., pivot) to a fourth position 110 to raise and transition the clutch sleeve 96 to the disengaged state corresponding to second position 100 in order to connect and disconnect the spin tube 92 (and ultimately the basket 30) to and from the agitator shaft 80 and a corresponding a power path from the motor 41, respectively.

An actuator 112 is configured to transition the lever 106 between the third and fourth positions 108, 110. The lever 106 may be configured to rotate about a one or more pins or pivots 114 between the third and fourth positions 108, 110. The actuator 112 may be connected to the lever 106 via a string, cable, or wire 116. The actuator 112 may include an electric motor 118 and a spool 120. The spool 120 may be connected to the motor 118 and the wire 116. The wire 116 may be wound about the spool 120. The motor 118 may be configured to rotate the spool 120 in first and second directions to increase or decrease the tension acting on the wire 116, respectively. The actuator 112 may be in communication with and controlled by the controller 70.

The actuator 112 is configured to increase a tension acting on the wire 116 to transition the lever 106 to the third position 108, which in turn activates the clutch sleeve 96 and transitions the clutch sleeve 96 to the engaged state corresponding to first position 98 to connect the spin tube 92 (and ultimately the basket 30) to the agitator shaft 80, the motor 41, and the corresponding power path from the motor 41. The actuator 112 is configured to decrease the tension acting on the wire 116 to facilitate transitioning the lever 106 to the fourth position 110, which in turn deactivates the clutch sleeve 96 and transitions the clutch sleeve 96 to the disengaged state corresponding to second position 100 to disconnect the spin tube 92 (and ultimately the basket 30) from the agitator shaft 80, the motor 41, and the corresponding power path from the motor 41. A spring 122 may be configured to bias the clutch sleeve 96 and toward the engaged state corresponding to first position 98 in response to releasing the tension on the wire 116.

The actuator 112 may be oriented at an angle θ such that the actuator 112 extends radially outward and upward relative to a center of the second pulley 86. The actuator 112 may also actuate on an axis the extends radially outward and upward relative to a center of the second pulley 86. The axis may overlap the wire 116 illustrated in FIGS. 3A and 3B. The actuator 112 may more generally extend upward from the second pulley 86 and radially outward from a rotational axis 126 of the second pulley 86. The angle θ may be measured relative to a horizontal plane. The actuator 112 may partially overhang the second pulley 86. The actuator 112 may partially extend radially beyond an outer periphery 128 of the second pulley 86 when viewing the second pulley 86 in a direction along the rotational axis 126 of the second pulley 86 (e.g., from a top or a bottom of the washing machine 10). The lever 106 may be disposed above the second pulley 86 and within the outer periphery 128 of the second pulley 86 when viewing the second pulley 86 in the direction along the rotational axis 126 of the second pulley 86 (e.g., from a top or a bottom of the washing machine 10). More specifically, the lever 106 may be disposed above the second pulley 86 and completely within the outer periphery 128 of the second pulley 86 when viewing the second pulley 86 in the direction along the rotational axis 126 of the second pulley 86 (e.g., from a top or a bottom of the washing machine 10).

The clutch system 94 further includes a bracket 130. The bracket 130 is secured to an external panel or housing 132 of the washing machine 10. The external panel or housing 132 may be part of the cabinet 14 or may be attached to the cabinet 14 via the suspension system 22. The bracket 130 is configured to secure the actuator 112 to the cabinet 14. The bracket 130 is also configured to orient the actuator along the angle θ. The lever 106 may be rotatably secured to the bracket 130 via the one or more pivots 114. The bracket 130 may include stanchions protruding therefrom. The lever 106 may be pivotably secured to the stanchions. More specifically, the lever 106 may be secured to the stanchions via the one or more pivots 114, where the one or more pivots 114 engage and are rotatably disposed within orifices defined by the stanchions.

The lever 106 may include a forked end 134 and an opposing or rear end 136 that are disposed on opposing sides of the one or more pivots 114. The rear end 136 may be secured to the wire 116 while the forked end 134 engages the clutch sleeve 96. Increasing and decreasing the tension on the wire 116 results in the lever 106 pivoting about the one or more pivots 114 between the third and fourth positions 108, 110. In an alternative configuration a cylinder or electric solenoid having a push rod may be connected to the lever 106, and activation and deactivation of such a cylinder or electric solenoid may result in the lever 106 pivoting about the one or more pivots 114 between the third and fourth positions 108, 110.

The motor 41 may be a small brushless permanent magnet (sBPM) direction current (DC) motor (DC Motor). The total reduction ratio of the pulley and drive as explained above is combined into one single belt reduction ratio. An sBPM motor is capable of achieving high speeds (up to 12000 rpm) and hence can be used to spin faster than a permanent split capacitor (PSC) motor. An sBPM motor may also operate at lower speed with higher torque during the wash phase of the cycle. Therefore, a gear reduction system between the second pulley 86 an agitator (e.g., the clothes mover 38) is not be required when an sBPM motor is utilized. Eliminating such a gear reduction system and a corresponding housing for such a gear reduction system eliminates the possibility of oil leaks, eliminates any noise contributed by gears rattling or meshing with each other, and reduces cost by eliminating components.

Also, such an arrangement where a single shaft (e.g., agitator shaft 80) is disposed within a single tube (e.g., spin tube 92) increases the overall system stiffness. Such increased stiffness increases stability during higher spin speeds. The system described herein is also advantageous in terms of overall machine capacity (e.g., the capacity of the basket 30) due to a reduced height of the motor and the elimination of a gear reduction system.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A laundry machine comprising:

a spin tube;

an agitator shaft disposed within the spin tube;

an electric machine configured to generate power;

a first pulley secured to the electric machine;

a second pulley secured to the agitator shaft;

belt connecting the first pulley to the second pulley, wherein the first pulley, the second pulley, and the belt are configured to collectively (1) deliver power from the electric machine to the agitator shaft and (ii) drive a rotational speed of the agitator shaft at a lower speed relative to a rotational speed of the electric machine; and a clutch system comprising, a sleeve configured to transition between first and second positions to connect and disconnect the agitator shaft to and from the spin tube, respectively, a lever (i) engaging the sleeve and (ii) configured to pivot between third and fourth positions to transition the sleeve between the first and second positions, respectively, and an actuator configured to transition the lever between the third and fourth positions, wherein the actuator is oriented at an angle such that the actuator extends radially outward and upward relative to a center of the second pulley.

2. The laundry machine of claim 1, wherein a ratio of the rotational speed of the electric machine relative to the rotational speed of the agitator shaft resulting from the connection between the first pulley and the second pulley via the belt ranges between 3:1 and 13:1.

3. The laundry machine of claim 1, wherein the actuator partially overhangs the second pulley and partially extends radially beyond an outer periphery of the second pulley.

4. The laundry machine of claim 3, wherein the lever is disposed above the second pulley and within the outer periphery of the second pulley.

5. The laundry machine of claim 1, wherein the actuator is (i) connected to the lever via a wire, (ii) configured to increase a tension acting on the wire to transition the lever to the third position, and (iii) configured to decrease the tension acting on the wire to facilitate transitioning the lever to the fourth position.

6. The laundry machine of claim 1 further comprising a cabinet and a bracket, wherein (i) the bracket is configured to secure the actuator to the cabinet, (ii) the bracket is configured to orient the actuator along the angle, and (iii) the lever is rotatably secured to the bracket.

* * * * *